US009861903B1

(12) United States Patent
Mariasov

(10) Patent No.: US 9,861,903 B1
(45) Date of Patent: Jan. 9, 2018

(54) PORTABLE LIFE-SIZE THREE-DIMENSIONAL FIGURE AND METHOD OF ASSEMBLY

(71) Applicant: Alexander Mariasov, Las Vegas, NV (US)

(72) Inventor: Alexander Mariasov, Las Vegas, NV (US)

( * ) Notice: Subject to any disclaimer, the term of this patent is extended or adjusted under 35 U.S.C. 154(b) by 0 days.

(21) Appl. No.: 15/284,316

(22) Filed: Oct. 3, 2016

(51) Int. Cl.

| | |
|---|---|
| ***A63H 3/16*** | (2006.01) |
| ***A63H 3/00*** | (2006.01) |
| ***A63H 3/28*** | (2006.01) |
| ***A63H 3/46*** | (2006.01) |
| ***A63H 3/50*** | (2006.01) |
| ***F21S 9/02*** | (2006.01) |
| ***F21V 33/00*** | (2006.01) |
| *F21Y 115/10* | (2016.01) |

(52) U.S. Cl.
CPC ..... *A63H 3/16* (2013.01); *A63H 3/006* (2013.01); *A63H 3/28* (2013.01); *A63H 3/46* (2013.01); *A63H 3/50* (2013.01); *F21S 9/02* (2013.01); *F21V 33/008* (2013.01); *F21Y 2115/10* (2016.08)

(58) Field of Classification Search
CPC . A63H 3/00; A63H 3/006; A63H 3/04; A63H 3/16; A63H 3/28; A63H 3/36; A63H 3/46
See application file for complete search history.

(56) References Cited

U.S. PATENT DOCUMENTS

| | | | | |
|---|---|---|---|---|
| 2,149,254 A * | 3/1939 | Corswirt | ..... | A63H 3/16 446/387 |
| 3,325,939 A * | 6/1967 | Ryan | ..... | A63H 3/04 446/374 |
| 3,419,993 A * | 1/1969 | Rodgers | ..... | A63H 3/16 446/100 |
| 4,274,224 A * | 6/1981 | Pugh | ..... | A63H 3/46 446/375 |
| 5,044,960 A * | 9/1991 | De Porteous | ..... | A63H 3/46 434/267 |
| 5,378,187 A * | 1/1995 | Forbes | ..... | A63H 3/50 248/224.8 |
| 5,480,341 A * | 1/1996 | Plakos | ..... | A63H 3/16 434/274 |

(Continued)

*Primary Examiner* — Gene Kim
*Assistant Examiner* — Alyssa Hylinski
(74) *Attorney, Agent, or Firm* — Carrie Stroup

(57) ABSTRACT

A portable, lightweight, full-sized (three to nine feet in height), articulated, 3D figure affixed to a platform for stability, and having the ability to be easily dis/assembled from a mailed box. The figures are repositionable in a life-like manner; and comprise: an internal tube-shaped skeletal frame with ball and socket joints, that dis/assembles at the anatomical joints (e.g. neck, shoulder, elbow, wrist, hip, knee, ankle, etc.); a plurality of external body components, comprising rigid, hollow half-shells resembling human skin and muscle, that encase the skeletal frame; a head unit with a voice box, and eye sockets with LED's; and a rotatable right and left hand and foot unit. The 3D figure may have the appearance of a well-known entity because of pre-fabricated and installed facial features, hair, body structure, etc., or via snap on shields. Exemplary entities comprise: super heroes; sci-fi characters; cartoon or animated characters; and celebrities.

14 Claims, 9 Drawing Sheets

(56) References Cited

U.S. PATENT DOCUMENTS

| | | | | |
|---|---|---|---|---|
| 6,220,922 | B1 * | 4/2001 | Lee | A63H 3/46 446/371 |
| 6,800,016 | B2 | 10/2004 | Wittenberg et al. | |
| 6,817,921 | B2 | 11/2004 | Chin et al. | |
| 7,186,212 | B1 | 10/2007 | McMullen | |
| 8,591,283 | B2 | 11/2013 | Hahn | |
| 9,205,341 | B2 | 12/2015 | Higuchi et al. | |
| 9,440,158 | B1 | 9/2016 | Yano | |
| 9,610,512 | B2 * | 4/2017 | Bae | A63H 3/16 |
| 2004/0002279 | A1 * | 1/2004 | Wittenberg | A63H 3/04 446/85 |
| 2004/0018799 | A1 * | 1/2004 | Lee | A63H 3/36 446/373 |
| 2011/0097966 | A1 * | 4/2011 | Kronenberg | A63H 3/16 446/268 |
| 2011/0300312 | A1 * | 12/2011 | Hickey | A47G 33/02 428/3 |
| 2016/0096115 | A1 * | 4/2016 | Vargas | A63H 3/365 446/297 |

* cited by examiner

PORTABLE LIFE-SIZE THREE-DIMENSIONAL FIGURE AND METHOD OF ASSEMBLY

FIELD OF THE DISCLOSURE

This disclosure comprises various life-size mannequin-like figures or models, depicting a celebrity, that can be easily assembled/disassembled for boxing and shipping to the consumer. In particular, the portable figures comprise hollow shells covering a skeletal frame that enable a figure to stand upright on a platform, while being posable into different positions.

COPYRIGHT NOTICE

A portion of the disclosure of this provisional patent application document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

TRADEMARKS DISCLAIMER

The product names used in this document are for identification purposes only. All trademarks and registered trademarks are the property of their respective owners.

BACKGROUND OF THE DISCLOSURE

Often a consumer desires a life-like three-dimensional (3D) model of a well-known character or person to display in their home or business for entertainment or advertisement purposes. Non-limiting examples of model types include: super heroes; science fiction (sci-fi) characters; and celebrities, such as actors, musicians, politicians, public figures, and professional or college athletes.

The prior art includes life size figures that can be made to look like a well-known entity, but they are either two-dimensional (2D) cardboard displays, or similar to traditional store mannequins. The 2D displays are unrealistic, and they can be easily pushed over. And 2D models cannot be easily shipped to the consumer without bending and damaging the model. Additionally, the 3D mannequins-like figures are not easily portable because they can only be disassembled down to their arms, legs, torso, etc., which still requires considerable space and weight in a shipping container. And the facial features and body structure of the 3D mannequins are also generic so as not to distract from the appearance of the clothes that they are modeling. If the user desires the mannequin to have the appearance of a specific celebrity, s/he must special order the mannequin.

Therefore, there is a need within the entertainment and advertisement industries for a lightweight, full-sized, rigid while posable, 3D model with the ability to disassemble/assemble for shipping via standard mail. The figure-model can have the appearance of a specific well-known entity, either via pre-fabrication of the face and body, or via Snap-On features (such as a molded face shield, and a particular body shape).

SUMMARY OF THE DISCLOSURE

The various embodiments of the present disclosure comprise a portable, lightweight, full-sized, articulated, 3D figure with the ability to be easily assembled and disassembled from a package/box that can be shipped via standard mail.

The figure-model may have the appearance of a well-known entity, such as a celebrity, because of pre-fabricated and installed facial features, hair, body structure, etc. Alternatively, the figure may be shipped with a generic appearing face and body type, and with shields that can be affixed to the external figure to give it the appearance of a specific entity, such as a face shield molded to look like a celebrity, and/or body shields that fit over the figure's assembled body to give it the appearance of an action figure in battle attire.

Non-limiting examples of model types included within the scope of the present disclosure comprise: super heroes (e.g. Ironman®, Hulk®, Batman®, etc.); science-fiction characters (Spock®); cartoon or animated characters (Pokémon®); and celebrities, such as actors, musicians, politicians, public figures, and professional or college athletes.

In one embodiment, the figures are able to stand upright without assistance. In another embodiment, the figures are able to stand upright by their feet being affixed to a flat platform.

The figures are articulated and thus repositionable in a life-like manner; and comprise: an internal skeletal frame that dis/assembles at anatomical joints (e.g. neck, shoulder, elbow, wrist, hip, knee, ankle, etc.); external body components, comprising hollow shells or cases resembling the appearance of human skin, that fits over and affixes to the frame; a skull unit with an optional voice box to emit pre-recorded and/or wirelessly transmitted audio, and an optional light source emitting from the eye sockets; a right and left hand unit; and a right and left foot unit.

Internal Skeletal Frame and Component Members:

The 3D figure comprises an articulated internal skeletal frame divided into human anatomical skeletal components, each component comprising a rigid or slightly flexible, straight, hollow or solid cylindrical tube shaped member with a joint assembly on both opposing ends of the member.

In one exemplified embodiment of the present disclosure, the internal skeletal frame comprises: a) a substantially inverted triangular shaped torso comprising a top horizontal cylindrical tube to simulate shoulders, and two side tubes extending from the opposing ends of the top shoulder tube to the bottom of the torso member to simulate a rib cage and waist, and a substantially short horizontal tube on the bottom to simulate a pelvis; b) eight cylindrical tube-shaped skeletal members sized to resemble a bone of a human skeleton, comprising: two humerus—upper arms; two radius-ulna—forearms, two femurs—upper legs; and two tibias—lower legs; and c) joint members on the distal and proximal ends of each skeletal member to enable them to rotate in a human-like manner relative to the adjoining skeletal member.

The internal skeletal frame may further comprise a plurality of short, thin (e.g. 2-4 inches in length), stick-shaped skeletal extension members that extend perpendicularly (front to back, or side-to-side) from the frame. The inner surface of the external body components affix to the stick extension members to stabilize the structural integrity of the 3D figure.

Joint Assemblies:

The articulated internal frame comprises joints that enable the adjoining external components to rotate relative to each other in a manner that is life-like. For example, the foot is able to rotate relative to the lower leg at the ankle joint; the head is able to rotate relative to the torso at the neck joint; the upper legs are able to rotate relative to the lower legs at the knee joint; the upper legs are able to rotate at the hip joint; the upper arms are able to rotate at the shoulder joint, and relative to the lower arm at the elbow joint; and the hands are able to rotate at the wrist joints by twisting.

External Component Members

The 3D figure further comprises a plurality of external articulated body components covering the internal skeletal frame, wherein each body component resembles a human anatomical body part comprising a rotatable upper or lower leg, upper of forearm, head, hand or foot unit. In the exemplified embodiment disclosed in the figures, a thin, hollow half-shell section is shaped to resembled a specific anatomical body part and able to snap into the opposing half shell section around the internal skeletal frame to create a complete body part comprising: an upper leg, a lower leg, a forearm, an upper arm, a torso and a pelvis, a head, and feet unit.

Head Unit:

The head unit may comprise one piece, or two divided shells (right and left, or front and back) of a skull that snap together. Whether the head unit is one member, or two or more members that fit almost seamlessly together, the head unit is made of substantially hollow, hard material The head unit may further comprise internal mechanisms for emitting recorded voice content from an electronic, battery powered, audio recorder housed within the skull unit; and/or live-streamed or recorded voice content that is wirelessly transmitted to a transmitter in the skull unit (e.g. Bluetooth®, wireless receiver, etc.). The head unit may further comprise a mechanism to give the appearance of life-like eyes, such as a battery powered light source positioned behind the artificial eyes, and/or an electrical-mechanical circuit that enables the eyes to move in a life-like manner.

Hand and Feet Units:

The two hand units are right and left opposing, made of solid material. Various embodiments of the hand units are envisioned within the scope of this disclosure, such as: a fixed hand unit comprising no moving parts; a semi-fixed hand unit comprising the ability of one or more finger members (e.g. the index, middle, ring and little finger are joined together) to be adjustable between a flat palm and a first position, and wherein the fingers may not be life-like; and a fully flexible hand unit resembling a human hand with moveable finger joints.

The feet units are right and left opposing, made of solid or hollow material, and shaped with the appearance of being a bare foot, or a shoe, or foot in a shoe (e.g. sandal). Each foot unit further comprises a mechanism for easily attaching and detaching the bottom of the foot unit to the platform (e.g. one or more holes sized matched to fit a dowel, bolt, screw, etc. extending vertically upward from the platform).

Platform:

the platform comprises a solid horizontal member able to affix the 3D figure feet to, and may comprise a variety of shapes, such as rectangular, square, cross, etc. It may comprise one unit, or be assembled from two or more units, in which the units are of small enough size and weight to easily ship with the 3D figure's disassembled parts via standard mail or other shipping services (UPS®). Furthermore, the height of the platform may be ordered from a selection of a variety of sizes of platforms ranging, for example, from less than an inch in height to 6 inches in height, while the width and length are only slightly larger than the assembled model's shoulder width. In one exemplified embodiment herein, the platform is in the shape of a cross about one inch in thickness.

Method of Assembly:

One exemplified method of assembling the 3D figure comprises: step (a) removing from a mail shipping container a plurality of 3D figure components comprising: an articulated internal skeletal frame divided into human anatomical skeletal components, each component comprising a rigid or slightly flexible, straight, hollow or solid cylindrical tube-shaped member with a joint assembly on opposing ends of the member; and a plurality of hollow half shells shaped as external articulated body components and sized to cover the internal skeletal frame, wherein each body component resembles a part of a human anatomical body part comprising a rotatable leg, arm, head, hand or foot unit; step (b) manually assembling the internal skeletal frame; and step (c) attaching the external body components to cover the internal skeletal frame. The method of assembly may further comprise: step (d) assembling the platform, and affixing the feet units to the platform to prevent the 3D figure from being easily tipped over.

BRIEF DESCRIPTION OF THE DRAWINGS

Other features, advantages and details appear, by way of example only, in the following description of embodiments, the description referring to the drawings in which.

DETAILED DESCRIPTION OF EXEMPLARY EMBODIMENTS

As used herein, the term "Portable" refers to the ability of the 3D figures, with or without a platform, to be easily disassembled and assembled from a small shipping container or box, such as one of approximately the size of: 24 inches in height, 16 inches in width and height; and for the 3D figure to be lightweight enough to be easily lifted and moved once assembled. Additionally, the height of the 3D figure, for example, ranges from about (+/−5%) 3 feet (e.g. when depicting child celebrities or sci-fi characters) to 9 feet (e.g. for super heroes, animated characters, etc.)

Figure 1:
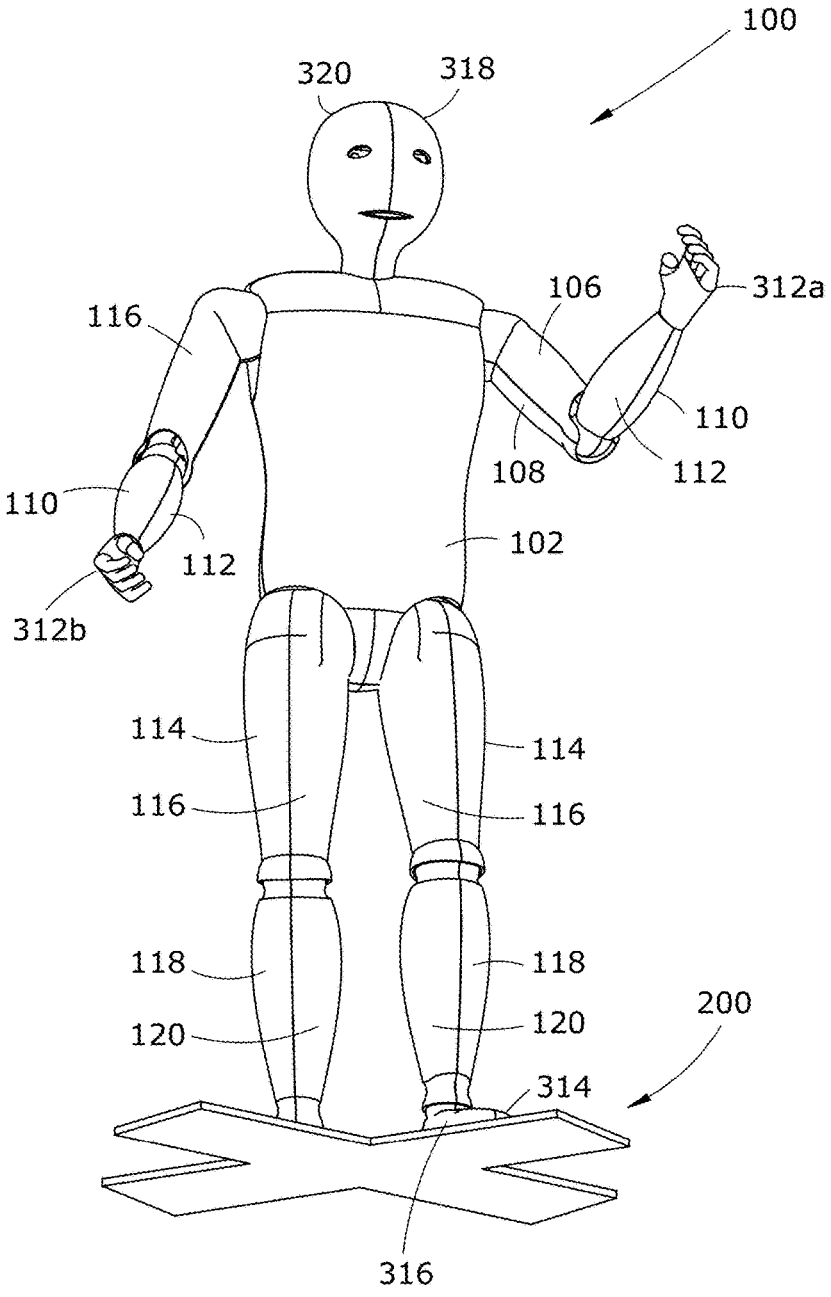
FIG. 1 is an illustration of a front view of an exemplary embodiment of the full size figure.
Figure 2:
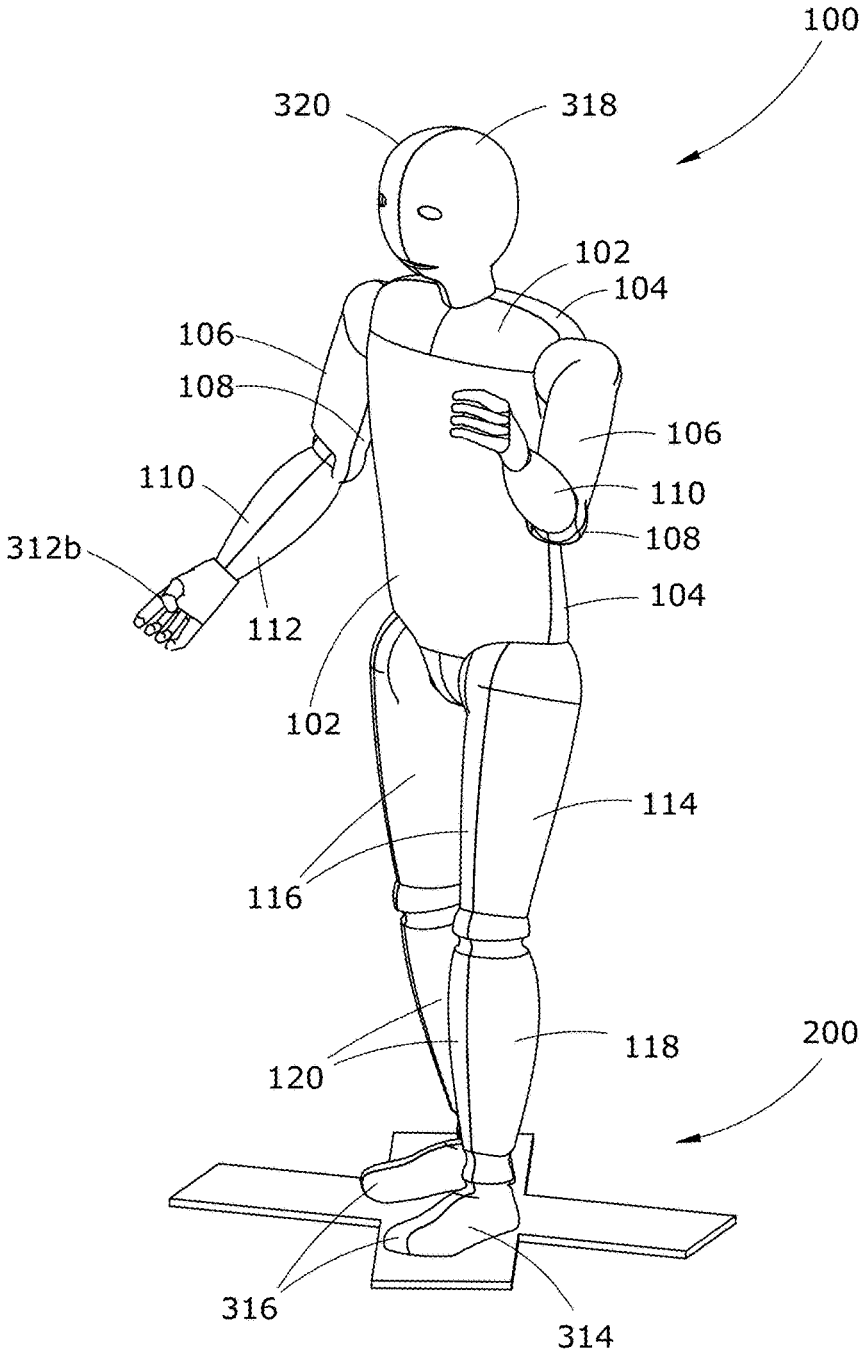
FIG. 2 is an illustration of a left perspective view of the exemplary embodiment of the full size figure.
Figure 3:
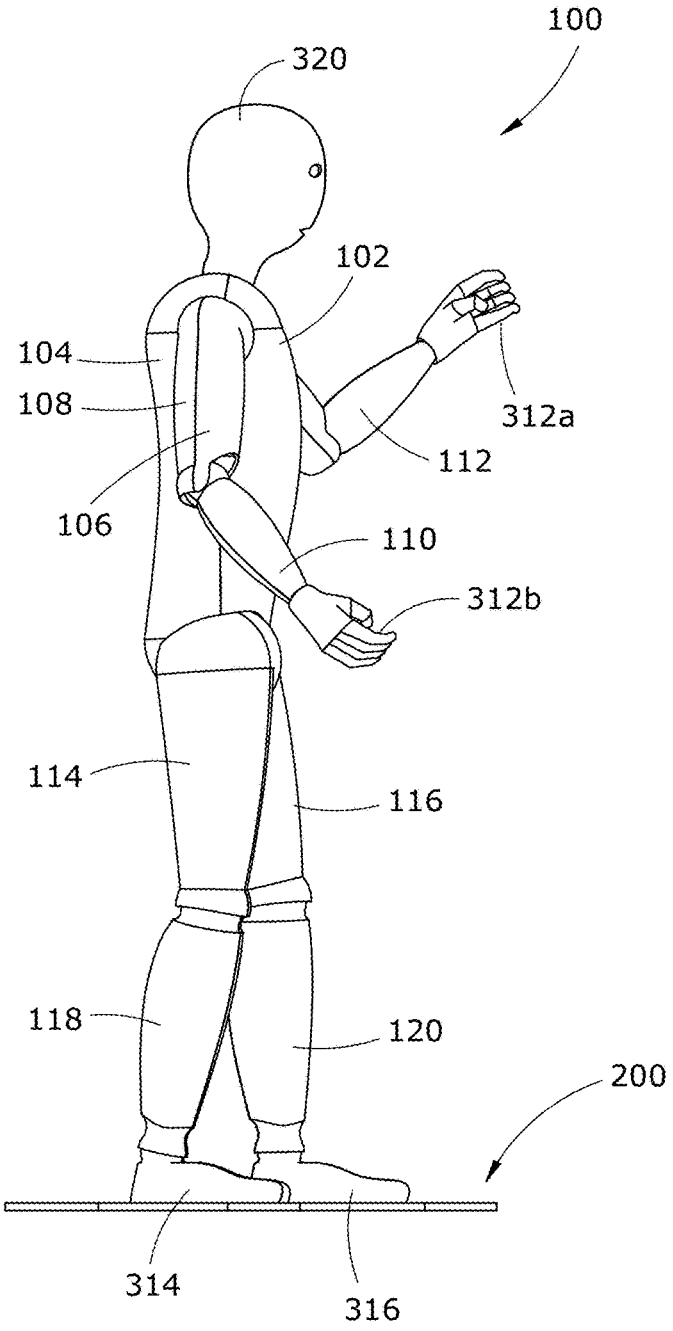
FIG. 3 is an illustration of a right side view of the exemplary embodiment of the full size figure.
Figure 4:
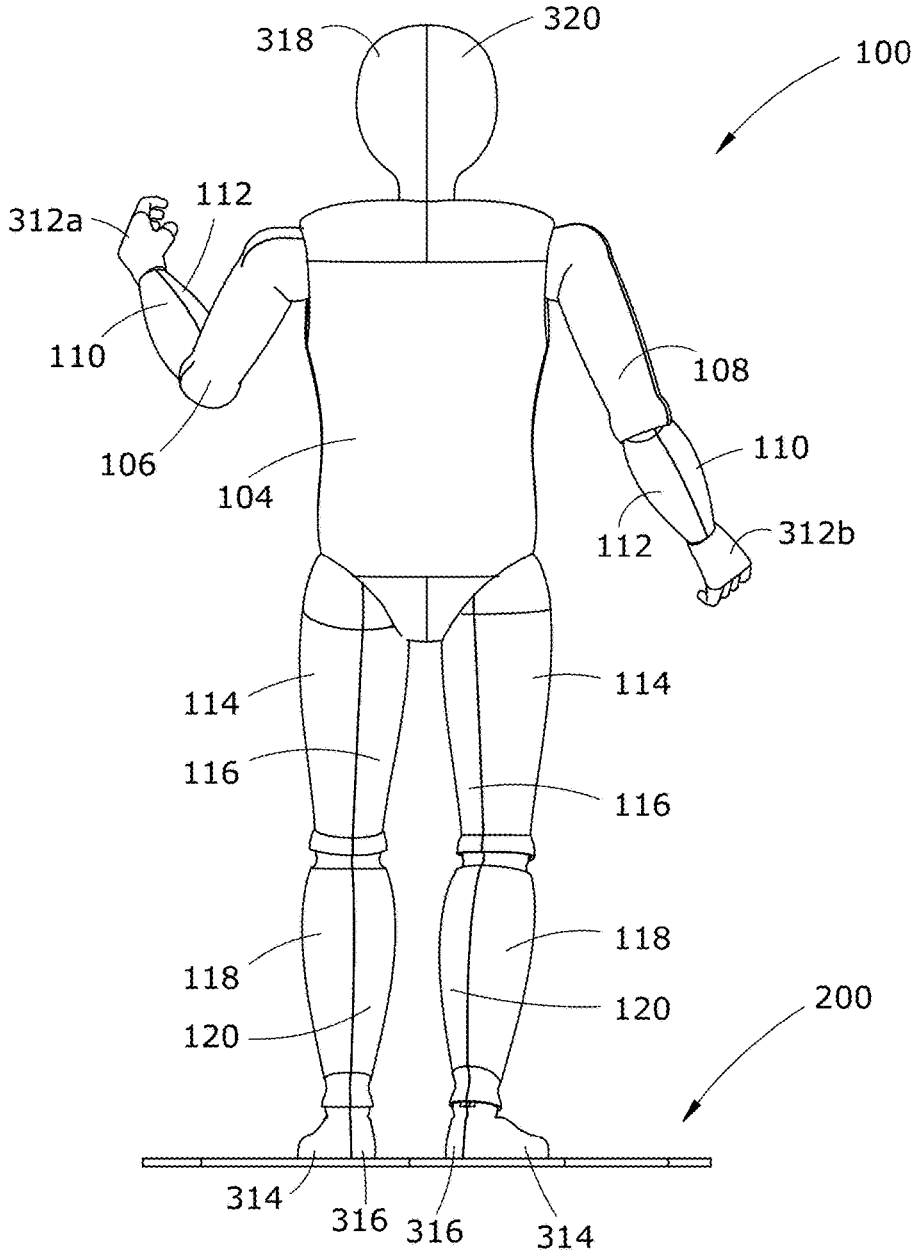
FIG. 4 is an illustration of a rear view of the exemplary embodiment of the full size figure.
Figure 5:
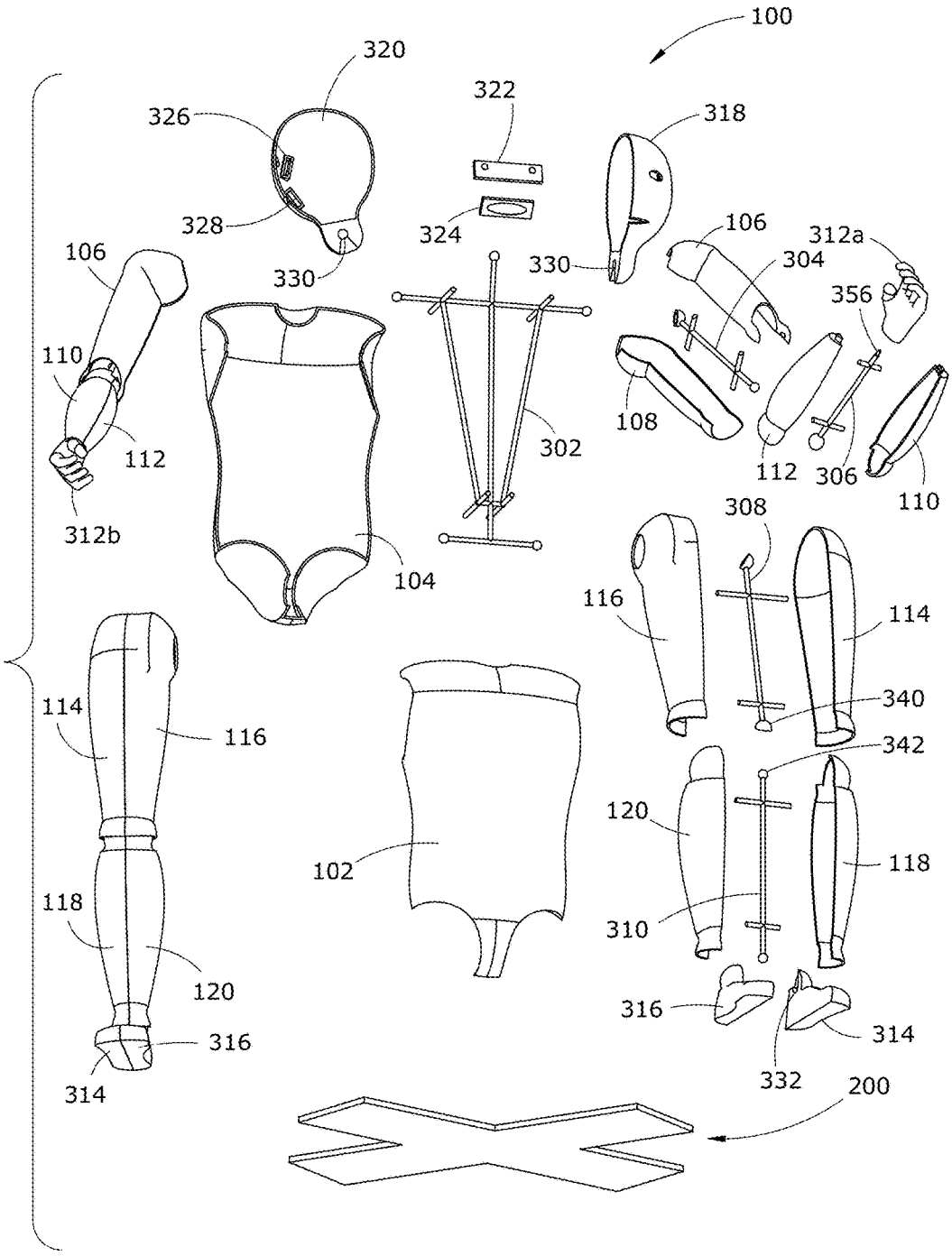
FIG. 5 is an illustration of an exploded view of the exemplary embodiment of the full size figure of FIGS. 1-4 comprising the internal skeletal frame and the external body component parts.
Figure 6:
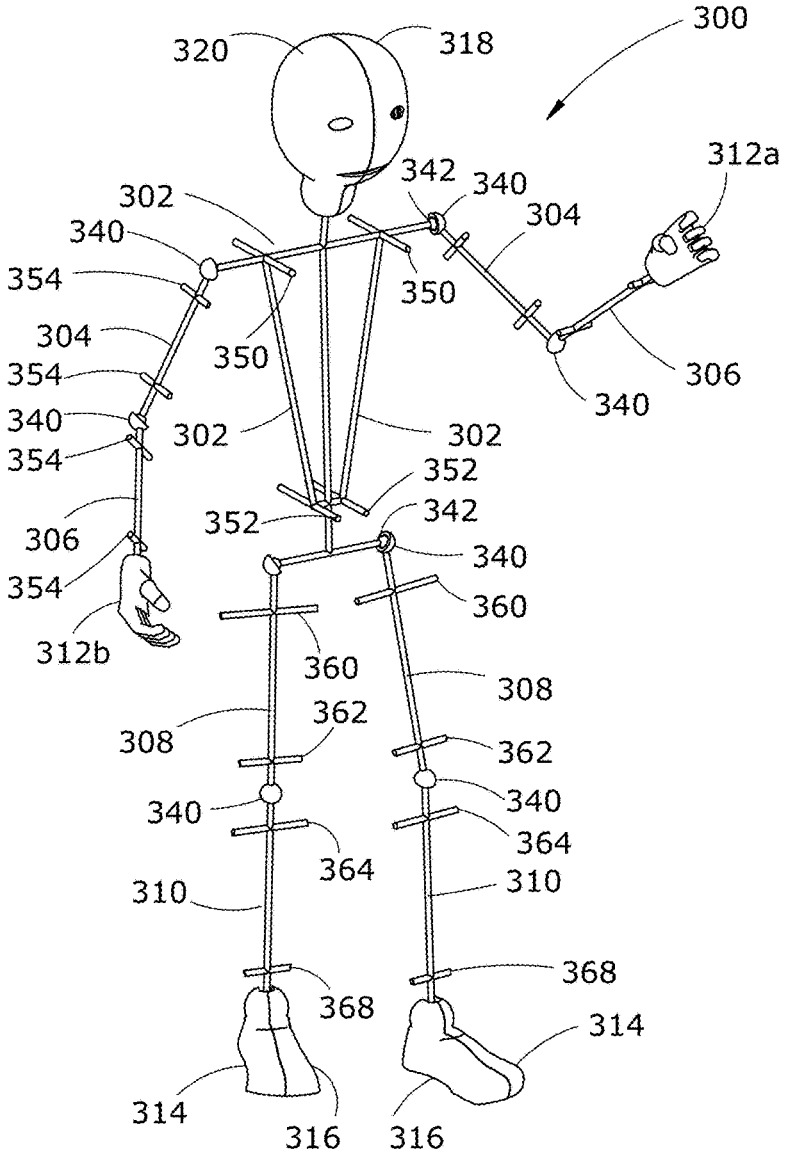
FIG. 6 is an illustration of a right perspective view of the internal skeleton frame of the exemplary embodiment of the full size figure of FIGS. 1-4.
Figure 7:
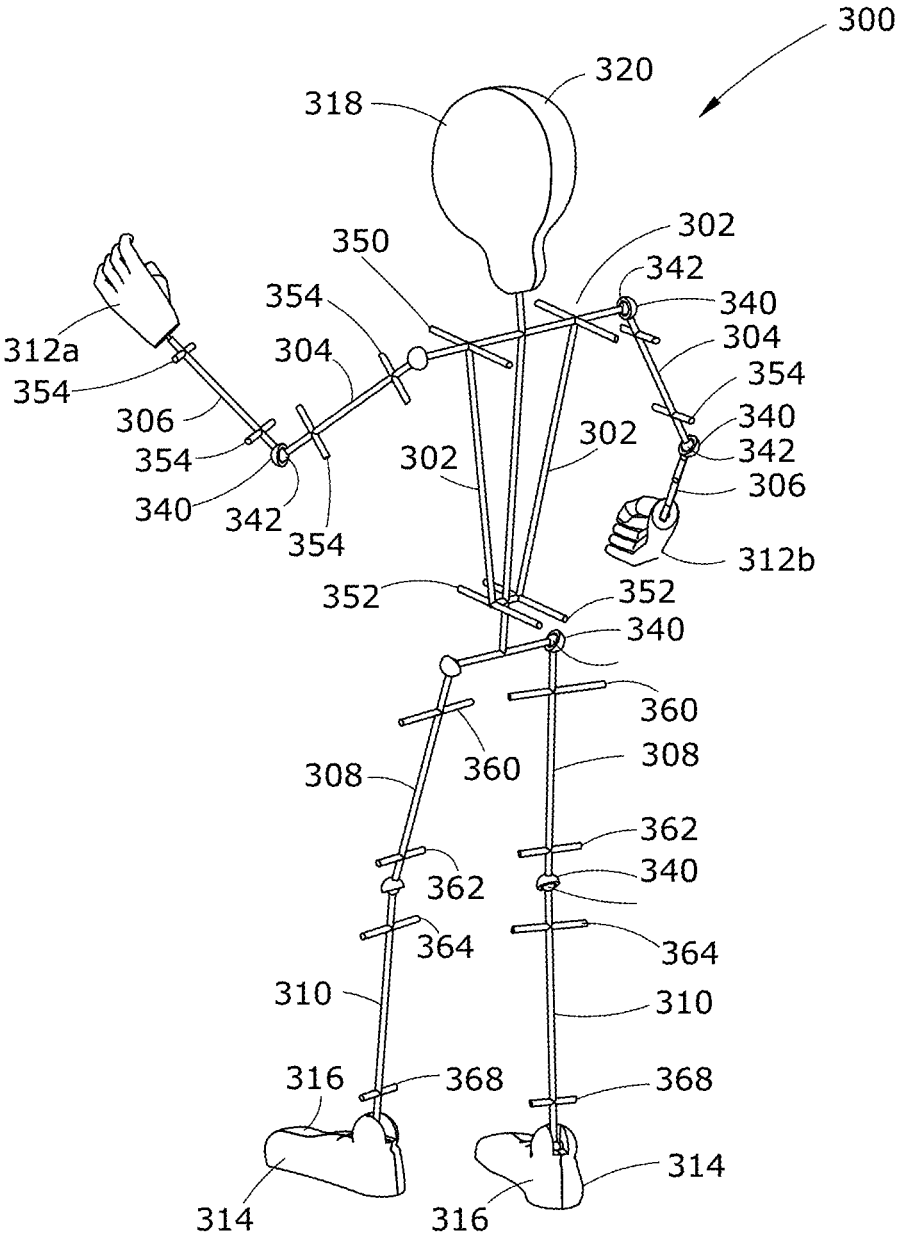
FIG. 7 is an illustration of a rear perspective view of the internal skeleton frame of the exemplary embodiment of the full size figure of FIG. 6.
Figure 8:
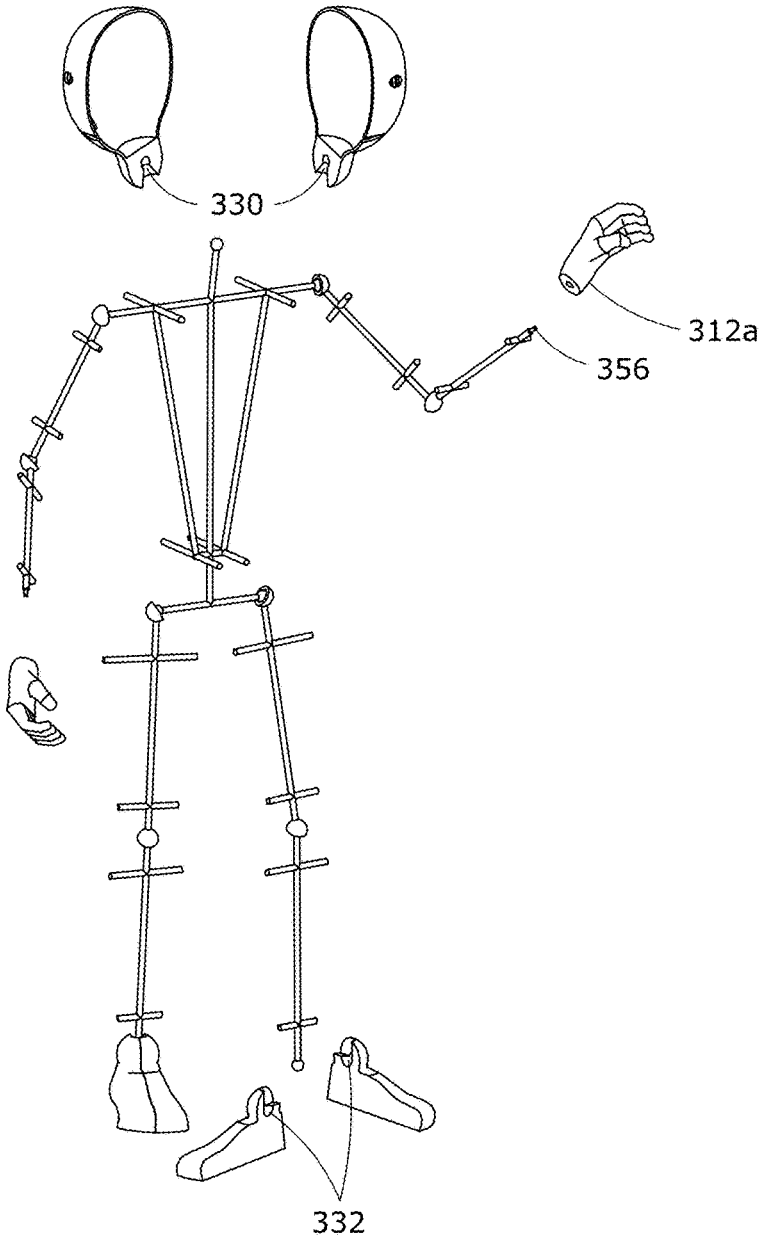
FIG. 8 is an illustration of a right perspective view of the internal skeleton frame with the head, hands, and feet detached to display the ball and socket, or dowel, mechanism of attachment.
Figure 9:
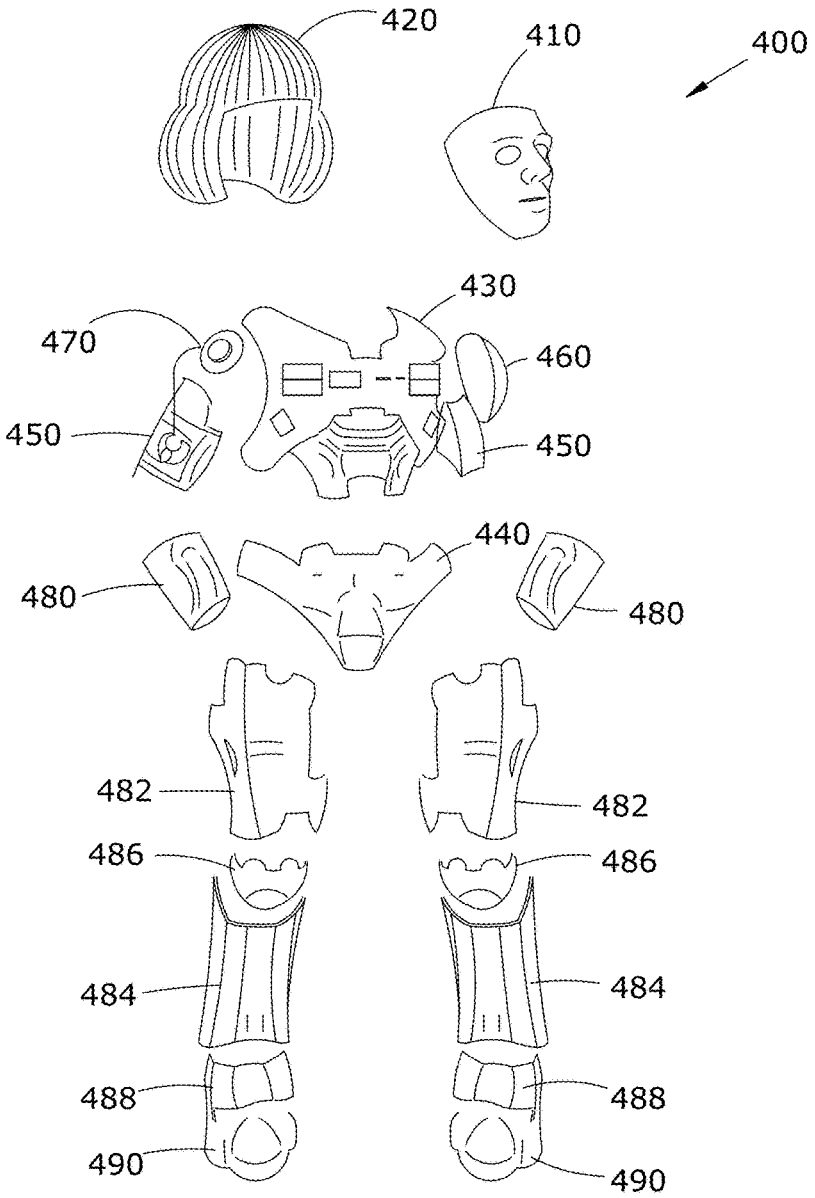
FIG. 9 is an illustration of a front view of the external shell components of another exemplary embodiment comprising an action figure's body armor suit.

FIGS. 1-4 illustrate from various perspectives a fully assembled portable, articulated, 3D figure that is affixed to a cross shaped platform 200; FIG. 5 is an exploded view of the external components 100 and internal frame components 300 of the 3D figure, which are listed by part number, name, and quantity per figure in Table 1 (external components) and Table 2 (internal components). Table 3 provides the part number and name for the skeletal frame (stick) extension members; and Table 4 provides the part number and name for the joints of the internal skeletal frame. FIGS. 6-8 provide various views of the internal skeletal frame 300; and FIG. 9 is an exemplification of a suit of armor worn on top of the 3D figure illustrated in FIGS. 1-8.

TABLE 1

EXTERNAL BODY COMPONENTS

| Part No. | Part Description | Quantity |
|---|---|---|
| 100 | Assembled Figure | 1 |
| 200 | Platform-Base | 1 |
| 102 | Front-Side Torso | 1 |
| 104 | Back-Side Torso | 1 |
| 106 | Front Half Upper Arm | 2 |
| 108 | Back Half Upper Arm | 2 |
| 110 | Front Half Lower Arm | 2 |
| 112 | Back Half Lower Arm | 2 |
| 114 | Outer Thigh | 2 |
| 116 | Inner Thigh | 2 |
| 118 | Outer Lower Leg | 2 |
| 120 | Inner Lower Leg | 2 |
| 312 | Hand (1 right, 1 left) | 2 |
| 314 | Outer Side of Feet | 2 |
| 316 | Inner Side of Feet | 2 |
| 318 | Left Side of Head | 1 |
| 320 | Right Side of Head | 1 |

TABLE 2

INTERNAL COMPONENTS FORMING A SKELETAL FRAME

| Part No. | Part Description | Quantity |
|---|---|---|
| 300 | Assembled Skeleton | 1 |
| 302 | Triangular Torso | 1 |
| 304 | Upper Arm | 2 |
| 306 | Lower Arm | 2 |
| 308 | Thigh-Femur | 2 |
| 310 | Shin-Tibia | 2 |
| 322 | Light Box-Eyes | 1 |
| 324 | Voice Box-Mouth | 1 |

TABLE 3

STICK EXTENSION MEMBERS

| | |
|---|---|
| 350 | Upper torso front/back sticks |
| 352 | Lower torso front/back sticks |
| 354 | Sticks on upper and lower arms |
| 360 | Thigh upper sticks |
| 362 | Thigh lower sticks |
| 364 | Shin upper sticks |
| 368 | Shin lower sticks |

TABLE 4

JOINTS ON THE SKELETAL FRAME

| | |
|---|---|
| 330 | Cutout in head to fit solid sphere |
| 332 | Cutout in feet to fit solid sphere (and not a peg). |
| 340 | Hollow sphere |
| 342 | Solid sphere |
| 356 | Peg end lower arm |

External Body Components:

FIG. 5 is an exploded view of one exemplified embodiment of the 3D figure disassembled into its various body parts. The external components are generally opposing, matching hollow half shells shaped to resembled a specific anatomical body part (e.g. see Table 1). Each half shell snaps into the opposing half shell in a substantially seamless manner and around the internal skeletal frame 300 (see Table 2) to create a complete body part (e.g. a thigh, calf/shin, forearm, upper arm, torso and pelvis, etc.). Each half shell also affixes to the internal skeletal frame for stability by attaching to stick extension members extending perpendicularly (e.g. front-to-back, or side-to-side) from the frame 300 (see Table 3). And each half shell (e.g. upper thigh) fits in a manner with the adjoining body part (e.g. lower leg) to cover the internal skeletal joints (e.g. knee joint) from public view and to simulate the 3D figure being able to move in a life like manner with rotatable joints (see Table 4).

The external body components are also made from a variety of solid materials to give the 3D figure a life-like appearance, while also being damage proof. By way of non-limiting examples, the external components comprise hard hollow shells for the skull, and hollow or solid material for the feet and hand members; and hard hollow shells for the legs, arms, and torso, which may be covered with slightly deformable outer materials to resemble elastic skin. To achieve a life-like appearance, the skin appearing hard shells may further comprise materials commonly used in the film industry, such as rubber, latex, plastic, and/or fiberglass materials or composites. And the eyes are made from glass and/or plastic materials with or without back lighting; and the hair is made from real or synthetic hair that is commonly used in wigs.

Internal Skeletal Frame

Various articulated skeletal frames are envisioned within the scope of the present invention that can fit within the external body half shells, while also providing the ability of the assembled 3D figure to stand upright unassisted, or while fixed to platform 200. In the exemplified embodiment of FIGS. 1-8, the internal skeletal frame 300 comprises a plurality of rigid, straight, hollow or solid cylindrical, tube-shaped members, jointed to create the upper and lower arms, as well as the upper and lower legs, and the torso.

Torso:

As exemplified in FIGS. 5-8, and torso 302 comprises a substantially inverted triangular frame comprising a top horizontal tube to simulate shoulders, and two inwardly angled side tubes extending from the opposing ends of the top shoulder tube to the bottom of the torso member to simulate a rib cage and waist. As listed in Table 3, supra, and illustrated in FIGS. 6 and 7, torso 302 further comprises at least four front-back stick extension members: two shoulder, or upper torso, extension members 350, and two waist, or lower torso extension members 352. The four members may be the same size, or shoulder members 350 may be a slightly different size than the waist members 352. Extension members 350 and 352 provide a mechanism for securely attaching the external torso shell components 102 front, and 104 back, to the frame (see FIG. 5). Torso 302 may also disassemble into two or more sub-components for packaging and shipment purposes, such as: by separating the two side tubes; and/or separating the shoulder tube; and/or removing the extension members 350 and 352 from torso 302; etc.

Arms and Legs:

In the exemplified embodiment of FIGS. 5-7, the arms of the skeletal frame 300 comprise two upper arm members 304 and two lower arm members 306. Likewise, the legs of the skeletal frame 300 comprise two upper legs (thighs-femur) 308, and two lower legs (shin-tibia) 310. Members 304, 306, 308, and 310 are hollow or solid tubular, or cylindrically shaped; and comprise lengths that are proportional to the 3D figure so as to depict an accurate model of what the 3D figure is intended to represent.

Joints:

Opposing ends of each rigid member (leg, arm, and torso) further comprise a joint mechanism to attach two adjoining members together so that they may move relative to each other in a manner that simulates the range of motion in an adult human—see Table 4.

As illustrated in FIGS. 5-8, the foot 314-316 is able to rotate relative to the lower leg at the ankle joint; the head 318-320 is able to rotate relative to the torso 102-104 at the neck joint; the upper legs 114-116 are able to rotate relative to the lower legs 118-120 at the knee joint; the upper legs 114-116 are able to rotate at the hip joint; the upper arm 106-108 is able to rotate at the shoulder joint, and relative to the lower arm 110-112 at the elbow joint; and the hands 312*a,b* are able to rotate at the wrist joints by twisting.

Ball and Socket Articulation:

As illustrated in FIGS. 5-7, points of attachment of two frame members comprise, by way of example: a hollow, half spherical joint end 340 that fits over a solid spherical end 342 on the adjoining internal frame component. To that end, the upper arm members 304 both comprise hollow, half spherical joint ends 340, while the lower arm members 306 comprise a solid spherical end 342 on both opposing ends. In another embodiment illustrated in FIG. 5, the lower end of the lower arm member 306 at the wrist joint comprises a dowel-peg end 356 that snaps into a hole centered in the bottom end of the hand member 312*a*, which allows the hand members to rotate around the lower arm members.

It should be appreciated that modifications and alterations obvious to those skilled in the art are not to be considered as beyond the scope of the present invention. For example, instead of providing ball and socket articulation, disc-in-cavity articulation could be provided for the intermediate connections.

Skeletal Materials:

the skeletal frame 300 is made from materials that are strong enough to allow the assembled 3D figure to stand without assistance, or while affixed to platform 200; and still be light enough to easily lift up and move the 3D figure, and economically ship a disassembled figure in a mail container. In an exemplary embodiment, the skeletal frame members are made from hard plastic composites with metal or plastic joint assembles. In another embodiment, the entire skeletal frame is made from a lightweight metal or metal composite, such as one comprising aluminum.

Head Unit

The head unit may comprise one piece, or two divided hollow shell halves (right and left as illustrated in the figures, or front and back) of a skull that snap together to display a substantially seamless head unit. In the exemplified embodiment of FIGS. 1-8, the skull is divided down the face midline to create a right side member 320 that is attachable to the left side member 318. Both halves are semi-spherical, hollow units, with pre-fabricated life-like facial features that are either generic to a human male or female, and may be of a specific age group (e.g. child, adult 20's, 40's, 60+ years of age). Or the face may be pre-fabricated with the appearance of a specific known entity, which by way of non-limiting examples, comprise: a super hero (e.g. Ironman®, Hulk®, Batman®, etc.); a science fiction character (Spock®); a cartoon or an animated character (Pokémon®); and a human celebrity comprising one or more of an actor-actress, a musician, a singer, a comedian, a politician, a public figure, and a professional or a college athlete.

As illustrated in FIGS. 5 and 8, the bottom of both halves 318, 320 also comprise a half spherical hole 330 to create a ball and socket joint for affixing the head unit to the skeletal frame 300 in a manner that allows the head to rotate in a seemingly life-like manner.

The head unit may further comprise internal mechanisms for emitting recorded or live-streamed voice content from an electronic, battery powered, sound box. Various types of well-known sound boxes are envisioned within the scope of the present disclosure, such as: an audio recorder housed within the skull unit; and/or live-streamed or recorded voice content that is wirelessly transmitted to a transmitter in the skull unit (e.g. Bluetooth®, wireless receiver, etc.). For example, FIG. 5 illustrates a socket 328 behind the mouth on the skull units 318 and 320 for holding a battery operated voice recorder 324 that can be activated/deactivated wirelessly, or via a power button, or a switch, that is affixed to the head unit internal or external surface.

The head unit may further comprise a mechanism to give the appearance of life-like eyes, such as a battery powered light source behind the eyes comprising light emitting diodes (LED's), and/or the ability to move the eyes in a life-like manner. For example, FIG. 5 illustrates a socket 326 behind each eye on the skull units 318 and 320 for inserting a light emitting unit 322.

In one embodiment, the eye LED's and the sound box are connected to the same electrical circuit that is attached to the head unit internal surface. Therefore, they are powered by the same battery and the same on/off switch. Various types of electrical circuits to emit sound and/or light from the head unit, on the same electrical circuit or different circuits, are within the skill level of the artisan.

Hand Units

In the exemplified embodiments of FIGS. 1-8, the right hand 312*a* and the left hand 312*b* are fabricated to be one piece members in which: the four fingers (index, middle, ring, little) are one unit moveable relative to the palm; or each finger is moveable relative to the palm in a life-like manner; or the hand is fixed into one position where the fingers are not moveable. The consumer when ordering the 3D figure may select the type of hand and be billed accordingly.

The hands may further comprise an internal hole at the base of the hand to create a ball and socket joint for the hand to attach to the skeletal frame. Or as exemplified in FIGS. 5 and 8, the forearm 306 of the skeletal frame may have a dowel 356 on the distal end that the hand unit fits onto, while still being able to rotate around member 306.

Feet Units

Each foot may be one unit that comprises an internal spherical hole on the top surface for a ball and socket joint, or a cylindrical hole to fit a dowel, from the lower leg 310 distal end so as to create a rotatable ankle.

Or as exemplified in FIGS. 5 and 8, each foot comprises two half units, an outer half 314 and an inner half 316 that snap together down the midline of the foot. And each half comprises half of a spherical hole that when the foot is assembled creates an opening 332 for a ball and socket joint at the ankle.

Method of Assembly

The order of assembling the internal skeletal frame 300, the external body component parts 100, and the platform 200, of the 3D figure is at the discretion of the user, hence the following disclosure is merely one exemplification of the order of steps. Alternative steps in the assembly of the figure are readily apparent to the artisan. In all embodiments, the user removes the external body components, the internal skeletal frame components, and the platform (optionally) from a mail shipping container; assembles the internal skeletal frame; and covers the frame with the external body components. And if so desired, affixes the 3D figure to the platform. The shipping box may comprise a variety of sizes, such as between about 18-28 inches in length, 13-18 inches in width, and 3-16 inches in thickness.

In one exemplary embodiment of the method of assembly using a platform 200 to stabilize the 3D figure, the internal skeletal frame 300 is partially assembled (upper and lower legs and feet), and then the bottom of the feet with the legs are attached to the platform 200.

The upper legs 308 are attached to lower leg shin-tibia members 310 at the knee joint ball and the socket joint 340, 342.

The feet members 314, 316 are attached to each other, then into the frame 300 lower legs frame members 310 using a ball and socket joint 332, FIGS. 5 and 8. Mechanisms of attachment of the bottom of the feet units to the platform are well known in the art, such as by using one or more dowels, screws, or bolts extending perpendicularly upward from the platform 200 and into size matched holes on the underside of the feet.

Then the remainder of the internal skeletal frame 300 is assembled by attaching the legs to the torso-pelvis: the torso-pelvis member 302 to the legs 308, and to the upper arm members 304 at the shoulder joint. And then adding the lower arm members 306 at the elbow joint.

The external body components are then attached to the internal skeletal frame. No particular order is required, but it is recommended that the torso, then the legs and/or the arms be attached, then the head and/or the hand units. The user is required to attach the inner surface of the hollow external components shells onto the stick extension members—i.e. sticks extending side-to-side (on the legs and arms) or front-to-back (on the torso), in order to secure the external body components to the skeletal frame—see Table 3. Various mechanisms of temporary attachment of the stick extension members to the inner surface of the external body components are envisioned within the scope of this disclosure, such as: holes or depressions carved into the inner surface of the external body components that the stick extension members snap or screw into; or Velcro-like material; or magnets; etc. Permanent mechanisms of attachment are also envisioned, such as: glue; screws; etc.

In one embodiment, the external body components 100 are attached to the internal skeletal frame 300 in the following order: the torso, then the legs, arms, head and hands. Per that order of assembly, the triangular shaped torso frame section 302 is covered on the front with the front-side torso 102 and the back with the back-side torso 104, securing both external components to the stick members 350 (upper), 352 (lower), and the skeletal frame and to each other. Shell section 102 snaps securely to shell section 104 in a substantially seamless manner by methods well known in the art, and resulting in a smooth surface with a slightly visible line where the shell sections join.

As illustrated in FIGS. 5-8, the lower legs should be assembled before the upper legs because the upper leg members 114, 116 rest on top of the lower leg members 118, 120 at the knee joint. The outer lower leg-shin-tibia member 118 is attached to the lower leg skeletal frame member 310 at stick extension members 364 (upper) and 368 (lower), and also to the inner lower leg-shin-tibia 120. The diameter of the shin members 118, 120 reduces from the knee to the ankles, therefore extension members 364 may be slightly longer than members 368.

Then on each leg, the outer thigh member 114 is attached to the inner thigh member 116 around the frame 308 and to the stick extension members 360 (upper) and 362 (lower). Because the diameter of the thigh reduces from the hip to the knee, extension members 360 may be slightly longer than members 362.

Likewise, the arms are assembled with the bicep-humerus upper arm members lying over the forearms at the elbow joint. Therefore, the outer lower arm 110 is connected to the frame member 306 at upper and lower extension members 354, and to the inner lower arm 112. Then the front upper arm member 106 is connected to the frame member 304 at the upper and lower extension members 354, and to the back upper arm 108.

As illustrated in FIGS. 5-8, the skull right side member 320 is attached to the left side member 318 and onto the torso 302 at the ball and socket joint 330. And the right hand member 312*a* and the left hand member 312*b* snap onto the dowel ends 356 on the forearms 306.

Action Figure Embodiment

FIG. 9 illustrates another embodiment comprising the supplemental external components of an action figure. The body armor suit 400 comprises: a face shield 410; a helmet unit 420; a chest shield 430; a pelvis shield 440; shoulder units 460, 470; two bicep shields 450; two forearm shields 480; two thigh shields 482; two knee shields 486; two shin shields 484; two ankle shields 488; and two foot shields 490.

In one embodiment, the shields snap onto to cover the assembled external body components of a generic 3D figure. In another embodiment, the shields are pre-installed parts of the external body components of Table 1.

Although the present disclosure has been described in detail for the purpose of illustration based on what is currently considered to be one of the most practical and preferred implementations, it is to be understood that such detail is solely for that purpose and that the various embodiments of the disclosure are not limited to the disclosed implementations, but, on the contrary, are intended to cover modifications and equivalent arrangements that are within the scope of the appended claims. For example, it is to be understood that the present disclosure contemplates that, to the extent possible, one or more features of any embodiment can be combined with one or more features of any other embodiment.

As used herein, the terms, "comprises" and "comprising" are to be construed as being inclusive and open ended, and not exclusive. Specifically, when used in the specification and claims, the terms, "comprises" and "comprising" and variations thereof mean the specified features, steps or components are included. These terms are not to be interpreted to exclude the presence of other features, steps or components.

As used herein, the term "exemplary" means "serving as an example, instance, or illustration," and should not be construed as preferred or advantageous over other configurations disclosed herein.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

Unless defined otherwise, all technical and scientific terms used herein are intended to have the same meaning as commonly understood to one of ordinary skill in the art.

What is claimed is:

1. A portable three-dimensional (3D) figure apparatus comprising:

a lightweight, collapsible 3D model ranging in height from about three feet to about nine feet;

an articulated internal skeletal frame divided into human anatomical skeletal components, each component comprising a rigid or slightly flexible, straight, hollow or solid cylindrical tube-shaped member with a joint assembly on opposing ends of the component; wherein the internal skeletal frame further comprises, a substantially inverted triangular-shaped torso comprising a top horizontal tube to simulate shoulders, a bottom horizontal tube to simulate a pelvis, and two downwardly, inwardly angled side tubes extending from opposing ends of the top shoulder tube to simulate a rib cage and a waist;

eight cylindrically-shaped skeletal members sized to resemble a bone of a human skeleton, comprising: two humerus—upper arms; two radius-ulna—forearms, two femurs—upper legs; and two tibias—lower legs;

wherein the torso and eight skeletal members each comprise at least four thin, stick-shaped skeletal extension members extending perpendicularly from the torso and from each of the skeletal members;

wherein each skeletal member comprises a joint member on a distal end and a proximal end that enable the skeletal members to rotate in a humanized manner via a ball and socket joint created from a solid sphere on a first skeletal member rotating within a hollow, half spherical unit on an adjoining second skeletal member;

a plurality of external articulated body components covering the internal skeletal frame;

wherein each external articulated body component comprises two opposing solid, stackable, thin, hollow half-shell sections shaped to resembled a specific anatomical body part and the opposing half-shell sections snap together around the internal skeletal frame and affix to the skeletal extension members to create a complete stable body part comprising: an upper leg, a lower leg, a forearm, an upper arm, a torso and a pelvis, a head, and feet units; and wherein the internal skeletal frame and the external body components are separable, and are able to be disassembled to sections of body parts that are able to fit into a mail shipping box with a size range from about 18-28 inches in length, 13-18 inches in width, and 3-16 inches in thickness.

2. The 3D figure apparatus of claim 1, further comprising a cross-shaped support platform, wherein the 3D figure rests upon and is removeably affixed to the platform, and the platform is able to prevent the 3D figure from being easily tipped over.

3. The 3D figure apparatus of claim 1, wherein the external body components comprise:

a right and a left side half-shell for: the upper leg, the lower leg, the forearm, the head, and a foot; and, a front and a back half-shell for: the upper arm, and the torso-pelvis.

4. The 3D figure apparatus of claim 1, wherein the head unit further comprises a socket positioned behind each of a right eye and a left eye of the head unit, and a light emitting assembly positioned within each socket.

5. The 3D figure apparatus of claim 4, wherein the head unit further comprises a voice audio emitting assembly positioned behind a mouth of the head unit.

6. The 3D figure apparatus of claim 1, wherein the 3D figure has the physical resemblance to one or more of the following public figure entities: super heroes; science fiction characters; animated characters; and celebrities comprising entertainers, politicians, prominent public figures, and professional and college athletes.

7. The 3D figure apparatus of claim 6, wherein the physical resemblance is attributable to a snap on-off attachable face shield and/or one or more snap on-off body shields that cover the external body components.

8. The 3D figure apparatus of claim 6, wherein the 3D figure is manufactured for the external body components to physically resemble a specific public figure entity.

9. A method of manually assembling a portable three-dimensional (3D) figure apparatus, the steps comprising:

a. removing from a mail shipping container a plurality of 3D figure components comprising:

an articulated internal skeletal frame divided into human anatomical skeletal components, each component comprising a rigid or slightly flexible, straight, hollow or solid, cylindrical tube-shaped member with a ball and socket joint assembly on opposing ends of the component;

a substantially inverted triangular-shaped torso comprising a top horizontal tube to simulate shoulders, a bottom horizontal tube to simulate a pelvis, and two downwardly, inwardly angled side tubes extending from opposing ends of the top shoulder tube to simulate a rib cage and a waist;

eight cylindrically-shaped skeletal members, sized to resemble a bone of a human skeleton, comprising: two humerus—upper arms; two radius-ulna—forearms, two femurs—upper legs; and two tibias—lower legs;

wherein the torso and eight skeletal members each comprise at least four thin, stick-shaped skeletal extension members extending perpendicularly from the torso and from each of the skeletal members;

wherein each skeletal member comprises a joint member on a distal end and a proximal end that enable the skeletal members to rotate in a humanized manner via the ball and socket joint created from a solid sphere on a first skeletal member rotating within a hollow, half spherical unit on an adjoining second skeletal member;

a plurality of external articulated body components sized to cover the internal skeletal frame;

wherein each external body component comprises two solid, thin, stackable, hollow half-shell sections shaped to resembled a specific anatomical body part and the two half-shell sections snap together around the internal skeletal frame and affix to the skeletal extension members to create a complete body part comprising: an upper leg, a lower leg, a forearm, an upper arm, a torso and a pelvis, a head, and feet unit;

b. manually assembling the internal skeletal frame; and c. attaching and snapping opposing half-shell sections of the external body components together to cover the internal skeletal frame.

10. The method of assembling of claim 9, wherein the shipping container further comprises a flat support cross-shaped platform, and the feet units are removeably affixed to the platform to prevent the 3D figure from being easily tipped over.

11. The method of assembling of claim 9, wherein the external body components comprise a right and a left side half-shell for: the upper leg, the lower leg, the forearm, the head, and a foot; and, a front and a back half-shell for: the upper arm, and the torso-pelvis.

12. The method of assembling of claim 9, wherein the head unit further comprises a socket positioned behind each of a right eye and a left eye of the head unit, and a light emitting assembly positioned within each socket.

13. The method of assembling of claim 12, wherein the head unit further comprises a voice audio emitting assembly positioned behind a mouth of the head unit.

14. The method of assembling of claim 9, wherein the 3D figure has the physical resemblance to one or more of the following known entities: super heroes; science fiction characters; animated characters; and celebrities comprising entertainers, politicians, prominent public figures, and professional and college athletes; wherein the physical resemblance is attributable to a snap on-off attachable face shield and/or one or more snap on-off attachable body shields that cover the external body components, or wherein the 3D figure is manufactured for the external body components to physically resemble a specific public figure entity.

* * * * *